US005435456A

United States Patent [19]

Dubach

[11] Patent Number: 5,435,456

[45] Date of Patent: Jul. 25, 1995

[54] PLASTIC SNAP HINGE CLOSURE

[75] Inventor: Werner F. Dubach, Maur, Switzerland

[73] Assignee: Createchnic AG, Switzerland

[21] Appl. No.: 146,361

[22] Filed: Nov. 2, 1993

Related U.S. Application Data

[63] Continuation-in-part of Ser. No. 33,428, Mar. 18, 1993, Pat. No. 5,257,708, which is a continuation of Ser. No. 834,117, Feb. 11, 1992, abandoned.

[30] Foreign Application Priority Data

Feb. 12, 1991 [CH] Switzerland ..... 00423/91

[51] Int. Cl.[6] ..... B65D 43/24

[52] U.S. Cl. ..... 220/335; 220/339; 215/235

[58] Field of Search ..... 220/335, 339, 254, 259, 220/264; 215/235, 237, 238, 244

[56] References Cited

U.S. PATENT DOCUMENTS 3,289,877 12/1966 Wolf .
3,628,215 12/1971 Everburg .
3,629,901 12/1971 Wolf .
3,741,447 6/1973 Miles et al. .
3,933,271 1/1976 McGhie .
4,346,810 8/1982 Kneissl .
4,386,714 6/1983 Roberto et al. .
4,403,712 9/1983 Wiesinger .
4,414,705 11/1983 Ostrowsky .
4,487,324 12/1984 Ostrowsky .
4,545,495 10/1985 Kinsley .
4,573,600 3/1986 Dubach .
4,854,473 8/1989 Dubach .
4,915,268 4/1990 Lay et al. .
5,067,624 11/1991 Thanisch .
5,115,931 5/1992 Dubach .
5,322,176 6/1994 Dubach ..... 215/235
5,358,151 10/1994 Strasenburgh ..... 222/420
5,361,920 11/1994 Nozawa et al. ..... 215/237
5,368,176 11/1994 Thanisch ..... 215/235

*Primary Examiner*—Allan N. Shoap
*Assistant Examiner*—Stephen Cronin
*Attorney, Agent, or Firm*—Speckman, Pauley & Fejer

[57] ABSTRACT

A plastic snap hinge closure having a film hinge which connects a lower part to an upper part. At least one tension element having two opposite end portions is connected to a closure wall of the lower part and the upper part. Each tension element preferably has a cross section with an overall sinuous shape. A continuously elastic strap section of each tension element has an inner side and an outer side. The inner side has a plurality of inner grooves which are spaced and preferably positioned approximately parallel with respect to each other. The outer side has a plurality of outer grooves which are spaced and preferably positioned approximately parallel with respect to each other. An inner land is positioned between two adjacent inner grooves and an outer land is positioned between two adjacent outer grooves. Along an axis of elasticity of the continuously elastic strap section, each inner groove is positioned opposite a corresponding outer land and each outer groove is positioned opposite a corresponding inner land.

13 Claims, 6 Drawing Sheets

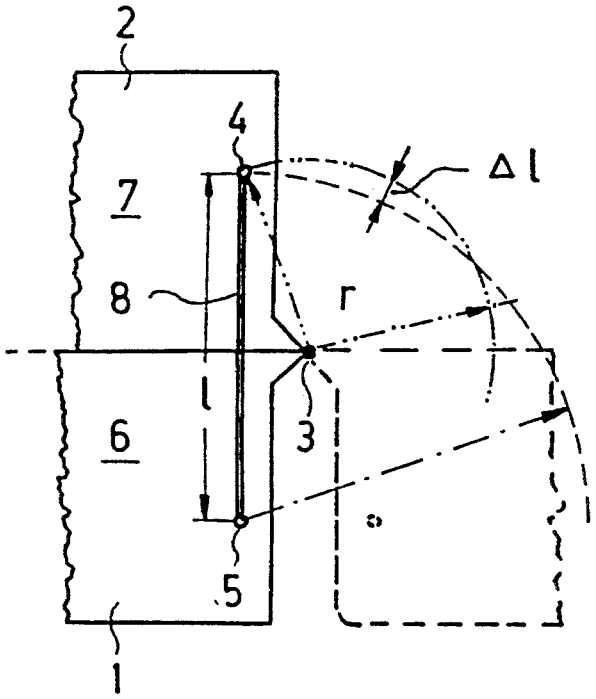
FIG. 1
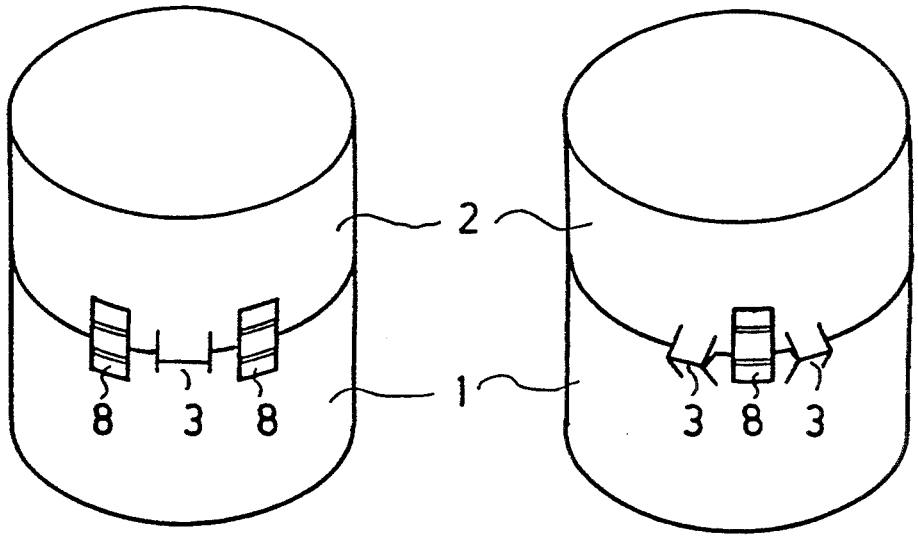
FIG. 2a
FIG. 2b

PLASTIC SNAP HINGE CLOSURE

CROSS-REFERENCE TO RELATED APPLICATIONS

This application is a continuation-in-part of U.S. Patent Application having Ser. No. 08/033,428, filed Mar. 18, 1993, now U.S. Pat. No. 5,257,708 which is a continuation of U.S. Patent Application having Ser. No. 07/834,117, filed Feb. 11, 1992, now abandoned.

BACKGROUND OF THE INVENTION

1. Field of the Invention

This invention relates to a plastic snap hinge closure having a lower part and an upper part connected with it by means of a film hinge, where the closure shell walls in the area of the film hinge are either straight or curved and have at least one tension element connected with both closure parts, preferably in one injection-molded piece, and each tension element is either directly or indirectly connected to the shell walls of both closure parts.

2. Description of the Prior Art

Conventional plastic snap hinge closures are known, for example, from my European Patent Disclosures Nos. 0 147 423 and 0 291 457. In the first mentioned patent disclosure, the tension elements are tension straps, which are produced by means of injection molding over consoles on the shell wall of the lower part and of the lid and thus are located in one plane. In the second mentioned patent disclosure, the tension straps are disposed extending approximately in or on the shell wall.

In the first mentioned example, the tension straps extend in one plane in the closed position and the attachment points of the tension straps are displaced out of the shell wall by consoles in such a way that they are located parallel to the main axis. In the second mentioned example, the tension straps extend in two planes which between them enclose an angle. Accordingly, the outer sections of each of the tension straps must travel a greater distance during opening than the inner sections of the straps located more closely to the hinge.

According to Wiesinger, European Patent Disclosure No. 0 056 469, instead of tension straps triangular intermediate elements, which verge with their tips into the main hinge, are disclosed.

Regarding an explanation of the operation of various conventional snap hinge closures, tension straps taught by the two first mentioned patent disclosures are supposed to elastically stretch and thus provide a snap effect. In practice, however, plastic materials used for plastic closures hardly have the ability of stretching elastically. This means that the desired snap effect cannot actually be achieved.

The function in connection with another embodiment taught by European Patent Disclosure No. 0 056 469 is correctly explained. The action of the snap closure is based on the elastic deformation of the closure in the area of the hinge. This means that in the course of each opening or closing of the closure, the shell wall of the lower part or the lid, or of the entire lid, arches in the area of the passage across the dead center position in the course of operation and subsequently is bent back into the relaxed, non-deformed shape.

Of course, this is an undesirable cooperation of forces which are hard to predict and interact in a complex manner. Attainment of the snap action can only be determined empirically and is difficult to predict. Easier to predict are results in connection with snap closures operating with a toggle joint, one of the levers of which extends into the surface of the lid and the other into the shell wall of the lid and the lower part. With these conventional closures, the snap effect depends on the force required to deform the two levers of the toggle joint. However, a hinge of this type is only suitable for closures having a small spout, where the lid itself does not close off the spout, but a sealing element placed thereon and cooperating with the spout closes off the spout, since the lid itself cannot seal because of the cuts along the toggle joint.

Accordingly it is desired to provide snap hinge closures, the snap effect of which does not depend on the elastic action of some arbitrary part of the closure, except for the tension element.

SUMMARY OF THE INVENTION

It is one object of this invention to provide a plastic snap hinge closure in which a snap effect can be achieved with at least one tension element.

According to one preferred embodiment of this invention, this object is achieved with a plastic snap hinge closure in which the at least one tension element each has a cross section with an overall sinuous shape. A continuously elastic strap section of each tension element has an inner side and an outer side. The inner side has inner grooves which are spaced and preferably parallel with respect to each other. The outer side has outer grooves which are spaced and preferably parallel with respect to each other. An inner land is positioned between each two adjacent inner grooves and an outer land is positioned between each two adjacent outer grooves. Each inner groove is alternatingly positioned with respect to the outer grooves such that each inner groove is positioned opposite the corresponding outer land and each outer groove is positioned opposite a corresponding inner land.

Further advantageous embodiments of the subject of the invention ensue from the dependent claims and are explained in the following description in conjunction with the drawings.

BRIEF DESCRIPTION OF THE DRAWINGS

FIG. 1 is a schematic functional view of the snap effect of a snap hinge closure in accordance with this invention, equipped with a longitudinally variable tension element;

FIGS. 2*a* and 2*b* are each a perspective view of a round snap hinge closure showing the position of the tension elements or of the tension element in relation to the main hinge;

FIG. 8*a* shows a side view corresponding to the completely opened position of the closure, after manufacture;

FIG. 8*b* shows the tension element of FIG. 8*a* in a position when the closure is completely opened;

FIG. 8*c* shows a tension element in the dead center position of the closure at maximum stretch;

FIG. 8*d* shows the tension element of FIG. 8*c* in a completely closed position;

DETAILED DESCRIPTION OF PREFERRED EMBODIMENTS

Figure 5A:
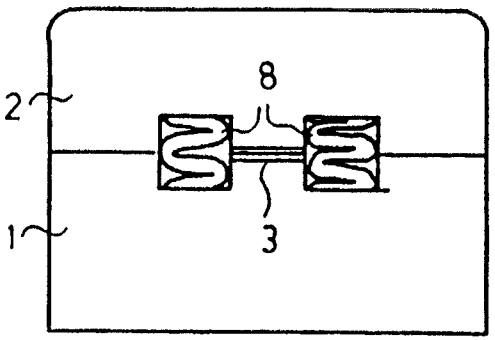
FIGS. 3*a* to 5*b* show three different embodiments of length-adjustable tension elements of round closures, wherein FIGS. 3*a*, 4*a* and 5*a* each show a rear view, looking towards the hinge of the closed closure, and wherein FIGS. 3*b*, 4*b* and 5*b* each show a top view of the respective embodiments in a completely opened state.

One preferred mode of operation of the closure in accordance with this invention is illustrated in the schematic view in accordance with FIG. 1. A lower part 1 of the closure can be placed, for example, on a container. In a closed position of the closure, the lower part 1 is covered by an upper part 2. In this way, the upper part 2 forms a lid or cap on the lower part 1. The two parts 1 and 2 are connected in one piece via a film hinge 3. The film hinge 3 forms the axis of rotation about which the upper part 2 can be pivoted approximately 180° with respect to the lower part 1. The film hinge 3 is outwardly displaced relative to the shell wall 6 of the lower part 1 and to the shell wall 7 of the upper part 2, which is preferably aligned with the shell wall 6.

To be able to produce the closure by injection molding in a completely open position, the film hinge 3 must be positioned outside of the shell walls 6 and 7. A schematically shown tension element is designated by the reference numeral 8. The tension element 8 has an upper attachment area 4, at which the tension element 8 is fastened on or connected to the upper part 2, and a lower attachment area 5, at which the opposite end of the tension element 8 is fastened on or connected to the lower part 1. Because the axis of rotation, formed by the film hinge 3, as well as the upper attachment area 4 of the tension element 8 are fixedly positioned on the closure, the upper attachment area 4 moves about the film hinge 3 along an arc of a circle with the radius r. However, the tension element 8 is not fastened on the axis of rotation of the film hinge 3 but rather on the lower attachment area 5 and therefore attempts to rotate about the lower attachment area 5. If the tension element 8 cannot stretch or be elongated, the upper attachment area 4 has to move on an arc of a circle having a radius l, where l corresponds to the length of the tension element 8. The difference between these two radii r and l with different axes of rotation inevitably results in a change in length of the tension element 8. This change in length is shown in the drawing by $\Delta l$. This change in length $\Delta l$ generates the force required to achieve a snap effect. The tension elements can be designed so that the change in length $\Delta l$ can be varied. Thus the force with which the closure performs a snap effect depends on relatively simple geometric considerations. In contrast to the snap hinge closures previously described, the difficult-to-predict change in the shape of the closure itself is not important in the mode of operation described above. The degree of elasticity can be affected by the design of the tension elements 8. Maximum change in length $\Delta l$ and the location of the dead center position are essentially only dependent from the disposition of the attachment areas 4, 5 relative to the film hinge 3. In this way, the designer has a large degree of freedom with respect to the design of a closure, in accordance with this invention. If, for example, in the preferred embodiment illustrated the two attachment areas 4, 5 are placed further inward while maintaining the length of the tension element 8, the radius r is increased by this and $\Delta l$ changes as well as the angular position of dead center. The optimization of the snap effect can be calculated, such as directly from the drawing, without experimentation. If the possible change in length $\Delta l$ is comparatively great, the tolerance range regarding the disposition of the attachment areas of the tension element 8 is also great. This is in clear contrast to the plastic snap hinge closures known so far, which only permit a small range of tolerance with respect to the geometric arrangement.

FIGS. 2*a* and 2*b* each show a snap hinge closure in a perspective view for the purpose of explaining the possible disposition of the snap hinge. The embodiment according to FIG. 2*a* shows a relatively narrow film hinge 3, via which the lower part 1 is hingedly connected with the upper part 2, and on both sides the film hinge 3 is a tension element 8, each positioned at the same distance from the film hinge 3. In contrast thereto, the embodiment in accordance with FIG. 2*b* shows two film hinges 3 at a certain distance from each other and also shows a centrally disposed tension element 8. In the construction of non-cylindrical plastic closures, it is possible to realize different combinations of one or more film hinges 3 with one or a plurality of tension elements 8.

Three plastic snap hinge closures in accordance with the embodiment of FIG. 2*a* are shown in FIGS. 3*a*, 3*b*, 4*a*, 4*b*, 5*a*, and 5*b*, which only differ in the design of the tension elements 8.

Figure 4A:
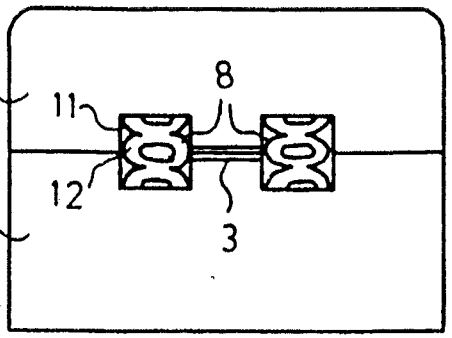
Figure 3A:
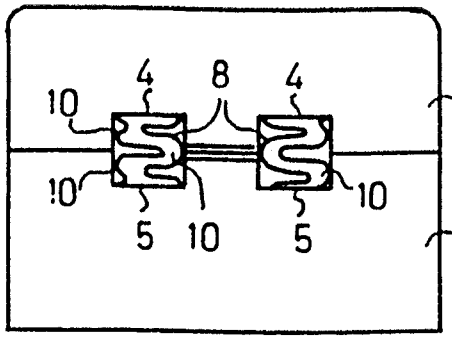
Figure 5B:
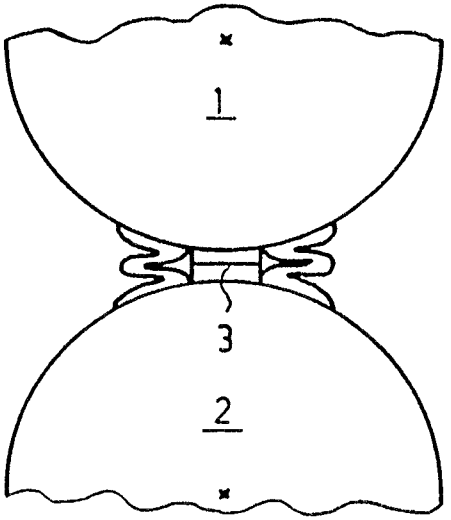
Figure 4B:
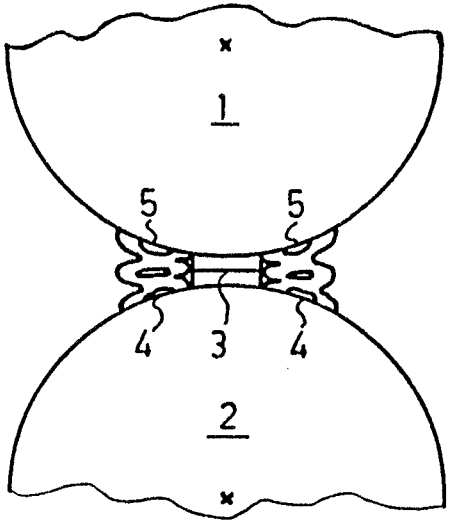
Figure 3B:
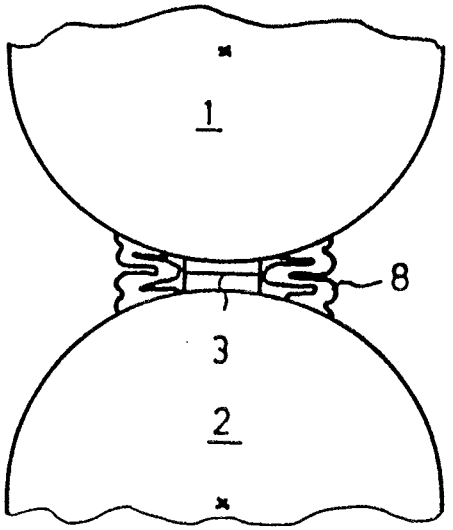

If FIGS. 3*a*, 4*a*, and 5*a* are considered, which each show the rear view of a closed closure, it is clear that the attachment areas 4, 5 of each individual tension element 8 extend parallel to each other when the closure is closed. However, in FIGS. 3*b*, 4*b* and 5*b*, the hinge areas of the respective closures are shown in the completely open position of the latter. In this position, each of the attachment areas 4, 5 extends obliquely to the other. It is possible to design the tension elements 8 in such a way that they are located straight in one plane in the completely open position of the closure, as shown in FIGS. 3*b*, 4*b* and 5*b*, but are completely relaxed. This would correspond to the manufacturing position. With this disposition of the tension elements 8, they would be slightly pre-stretched in the closed position of the closure. Thus, the tension elements 8 exert a certain amount of closing force even in the closed position of the closure. On the one hand, this increases the snap effect and, on the other hand, the closing movement is postponed until during the course of the snap effect.

The attachment areas 4, 5 of the tension elements 8 are each positioned at least approximately aligned with the shell walls 6, 7 in the illustrated examples. However, such arrangement is not necessary. The attachment areas 4, 5 could also simply verge over into bases or consoles which are produced by injection molding on the shell walls 6, 7 and which extend outward from the shell walls 6, 7. This preferred embodiment will be used particularly if it is desired to position the tension elements 8 on a round closure at a relatively far distance from the main hinge 3. In this case, an embodiment is also possible where the attachment areas 4, 5 of the tension elements 8 extend obliquely with respect to each other. The disposition of the tension elements 8 relative to the main hinge 3 as well as the position of the attachment areas 4, 5 with respect to each other will have an effect on the choice of the shape of the tension elements 8 or their partial sections.

The embodiment in accordance with FIGS. 3a and 3b shows the tension element 8 comprising three partial sections, generally in the shape of the letter C. The three C-shaped partial sections constitute a meandering or sinuous strap extending in a plane between the two attachment areas 4 and 5. The change in length of the tension elements 8 is achieved by spreading the partial sections 10. The more the tension elements 8 are stretched, the wider the C-shaped partial sections 10 are spread. The direction of opening of the C-shaped partial sections 10 alternates in this embodiment, but this is not an absolute requirement.

FIGS. 4*a* and 4*b* show an embodiment where the tension elements 8 do not comprise partial sections. While the partial section adjoining the attachment areas 4, 5 are semi-elliptical partial sections 11, a completely elliptical partial section 12 is disposed between them. It is of course also possible that the tension element 8 may comprise three such elliptical C-shaped partial sections. It is simply a question of definition, because five C-shaped partial elements could also be recognized or used just as easily in this shape. The more that such tension elements 8 are changed in their length, the more the elliptical partial sections are stretched into circular elements.

The embodiment in accordance with FIGS. 5*a* and 5*b* shows the tension elements 8 almost identical to those shown in FIGS. 3*a* and 3*b*. Only the partial sections 10 are disposed differently.

Figure 6A:
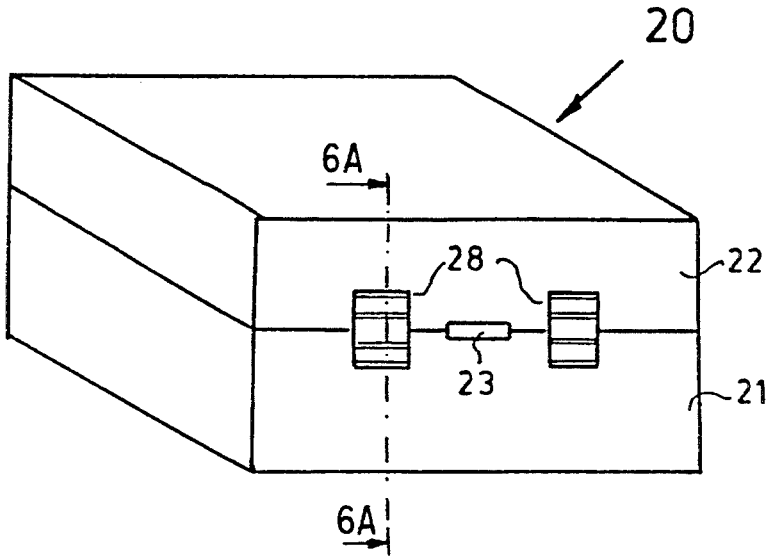
FIG. 6*a* shows another embodiment of this invention with the tension elements in connection with a box.
Figure 6B:
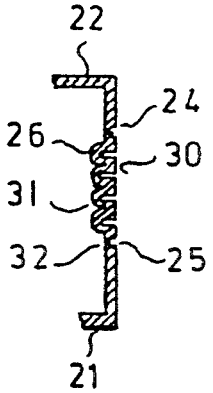
FIG. 6*b* shows a partial sectional view of the box, taken along the line 6A–6A of FIG. 6*a;*
Figure 7:
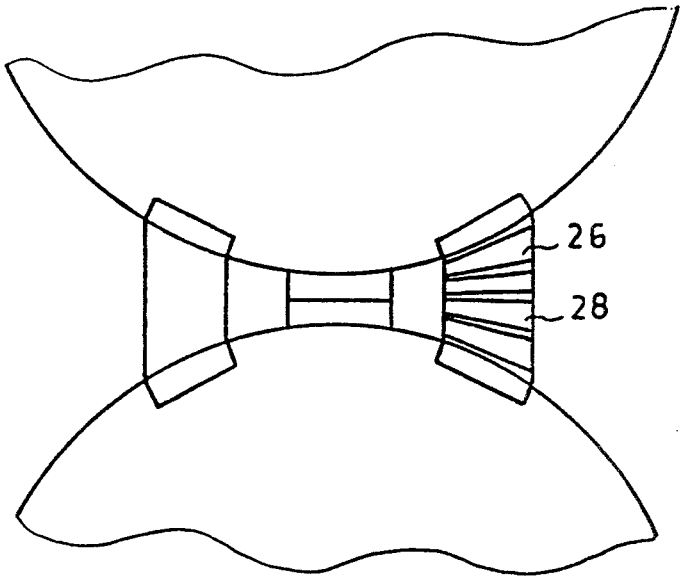
FIG. 7 shows another embodiment of a tension element similar to that shown in FIGS. 6*a* and 6*b*, in use with a round closure in its completely open position.

FIG. 6 shows that the use of the snap hinge closure in accordance with this invention is not limited to round or otherwise shaped closures of containers. In this embodiment, the snap hinge in accordance with this invention is fixed on a box 20. The box body 21 is connected with the box lid 22 via the main film hinge 23. Two tension elements 28 are positioned on both sides of the main film hinge 23. Each tension element 28 comprises four generally U-shaped partial elements 24. In contrast to the embodiments of the tension elements described so far, the partial sections 26 in this embodiment do not extend within the plane formed between the attachment areas 24, 25, but they meander in an accordion-like or sinuous manner in and out of the plane between the two attachment areas. In the embodiment shown in FIG. 6*b*, the tension elements 28 comprise several U-shaped partial elements which adjoin each other in such a way that they have a land or an area which is rounded towards the inside, with respect to the closure, and have a flat land or area towards the outside, with respect to the closure. In this embodiment, the land areas 30 are positioned in such a way that in the closed state of the closure they are located in an aligned plane together with the shell walls. However, the rounded lands in areas 31 of the partial sections 26 extend somewhat into the box 20, with respect to the shell wall. Such an embodiment of the tension elements 28 is not only suitable for boxes, but also for closures which are fixed on a container. In this embodiment of the tension element 28, too, the change in length $\Delta l$ is achieved by spreading the U-shaped partial elements 26. Although not required, the tension elements 28 can be formed by film hinges 32 near the attachment areas 24, 25. This has the advantage that the tension elements 28 always extend neatly in a plane generally defined as lying between the two attachment areas, regardless of the opening position of the closure or the lid 22. This in particular simplifies the design of the injection mold necessary to make the closure. If such a tension element 28 is attached to a round closure, such as illustrated in FIG. 7, in the completely opened state of the closure, the partial sections 26 form a fan-shaped strap which can be changed in length.

Figure 9A:
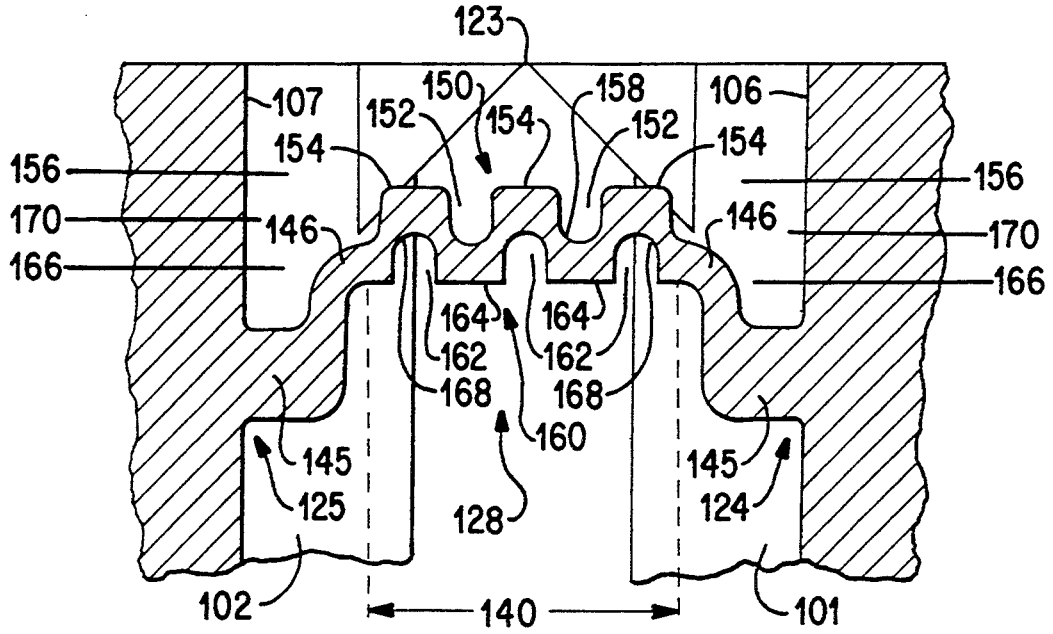
FIG. 9*a* is a sectional view taken along line 9*a*–9*a*, with the snap hinge closure in an open condition, as shown in FIG. 10.
Figure 9B:
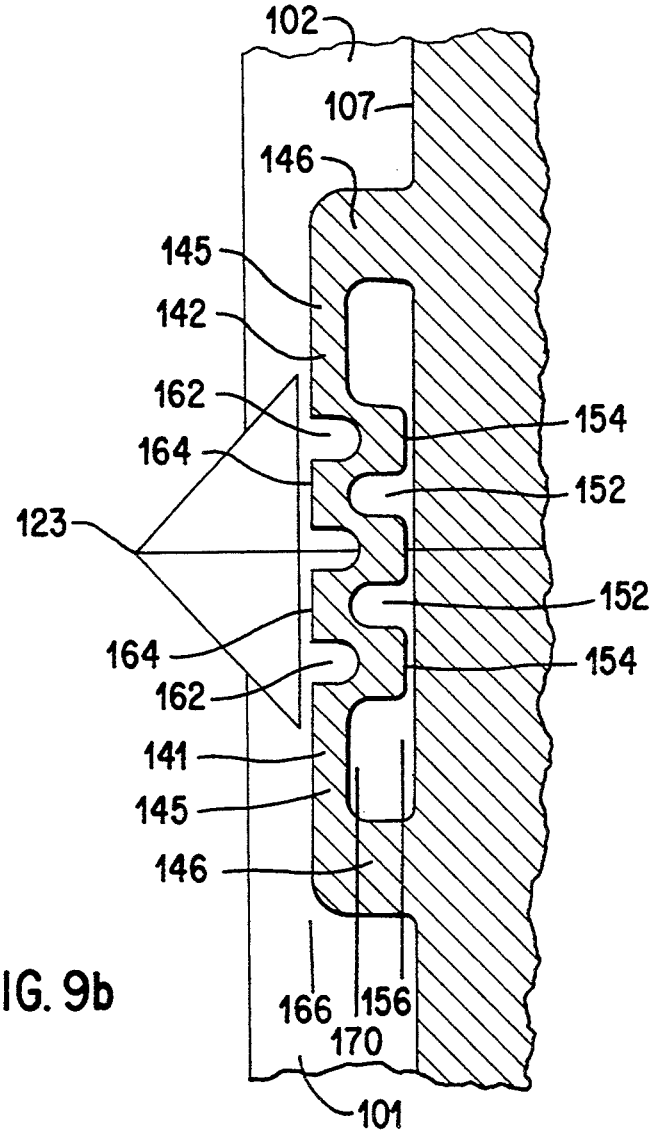
FIG. 9*b* is a sectional view as shown in FIG. 9*a*, but with the snap hinge closure in a closed condition.
Figure 10A:
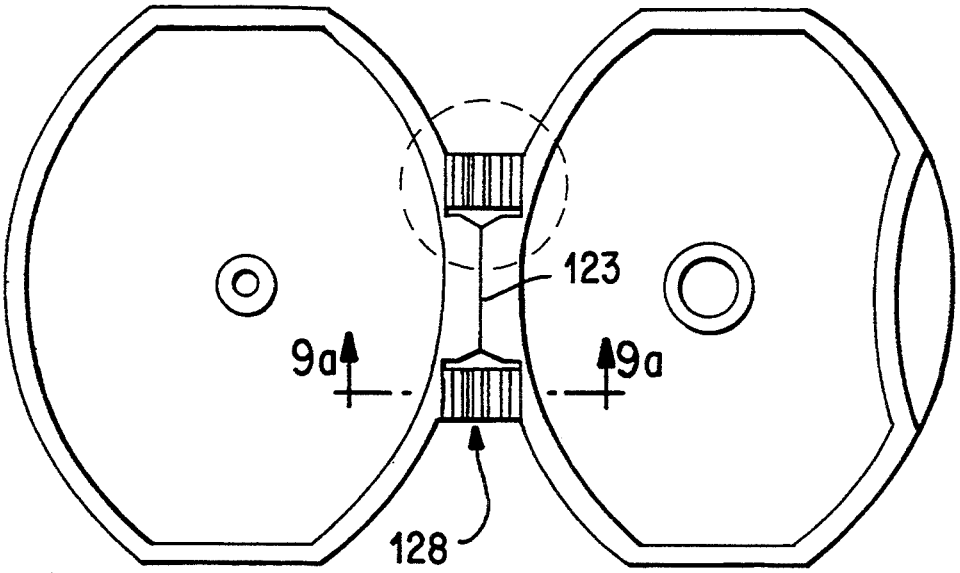
FIG. 10*a* is a top view of an upper part connected to a lower part, with one film hinge and two tension elements each positioned on opposite sides of the film hinge, according to one preferred embodiment of this invention.

FIGS. 9*a*, 9*b*, 10*a* and 10*b* show yet another preferred embodiment of the tension elements 28 according to this invention. As shown in FIG. 9*a*, the plastic snap hinge closure comprises a film hinge 123 which connects a lower part 101 to an upper part 102. FIG. 9*a* shows a sectional view taken along line 9*a*–9*a*, as shown in FIG. 10*a*, of the closure cap in an open condition. FIG. 9*b* shows the closure cap in a closed condition where the upper part 102 is rotated 180° in a clockwise direction, from the position shown in FIG. 9*a*, about the film hinge 123. At least one tension element 128 is connected to corresponding closure walls 106, 107. According to the preferred embodiment of this invention shown in FIG. 10*a*, the closure cap comprises two tension elements 128, one positioned on each side of the film hinge 123.

As clearly shown in FIG. 9*a*, the tension element 128 has two opposite end portions 124, 125 which are each connected to the corresponding closure wall 106, 107. The end portions 124, 125 can be connected by forming an integral element through injection molding, as shown in FIG. 9*a*, or can be connected by any other suitable connection means known to those skilled in the art.

As clearly shown in FIGS. 9*a* and 9*b*, the tension element 128 has a cross section with an overall sinuous shape. As shown in FIG. 9*a*, the continuously elastic strap section 140 provides the tension element 128 with elastic characteristics that allow a change in length $\Delta l$ along an axis of elasticity 170. Thus, as the tension element 128 moves from the open position of the closure, as shown in FIG. 9*a*, to the closed condition of the closure, as shown in FIG. 9*b*, the tension elements 128 can stretch, as previously discussed with respect to the tension element 28.

According to one preferred embodiment of this invention, the continuously elastic strap section 140 can be constructed with an inner side 150 and an outer side 160. The inner side 150 preferably has a plurality of inner grooves 152 which are spaced with respect to each other. Likewise, the outer side 160 preferably has a plurality of outer grooves 162 which are also spaced with respect to each other. In one preferred embodiment according to this invention, the inner grooves are positioned approximately parallel to each other. The outer grooves are also positioned approximately parallel to each other as well as approximately parallel with respect to the inner grooves 152, as clearly shown in FIGS. 9*a* and 10*b*. However, it is also apparent that the inner grooves 152 and/or the outer grooves 162 can be positioned at an angle with respect to each other, as shown in FIG. 7.

Figure 10B:
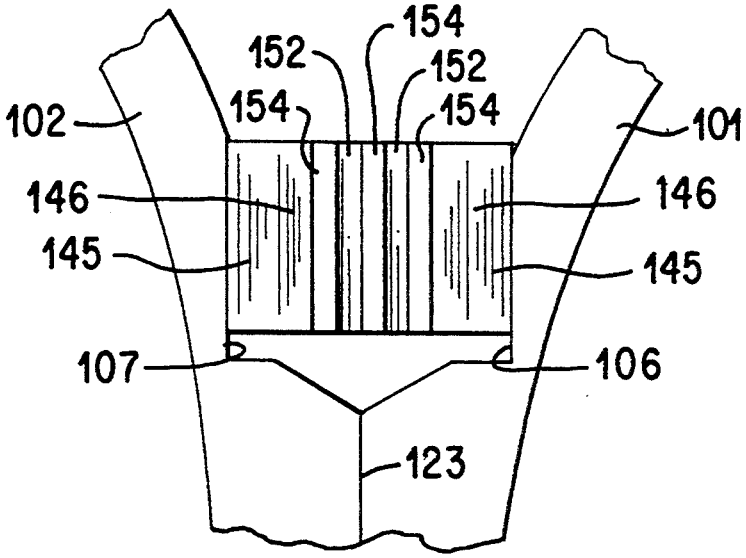
FIG. 10*b* is an enlarged top view of the portion of the snap hinge closure shown by the dashed circle in FIG. 10*a*.

As clearly shown in FIGS. 9*a*, 9*b* and 10*b*, according to one preferred embodiment in this invention, an inner land 154 is positioned between each two adjacent inner grooves 152. Likewise, an outer land 164 is positioned between each two adjacent outer grooves 162. Along the axis of elasticity 170 of the continuously elastic strap section 140, each of the inner grooves 152 is positioned opposite a corresponding outer land 164, and each of the outer grooves 162 is positioned opposite a corresponding inner land 154, as clearly shown in FIGS. 9*a* and 9*b*.

As shown in FIGS. 9*a* and 9*b*, each inner land 154 is flat and each inner land 154 lies approximately within the inner plane 156. Likewise, each outer land 164 shown in FIGS. 9*a* and 9*b* is flat and each outer land 164 lies approximately within the outer plane 166. FIGS. 6*b* shows another preferred embodiment according to this invention where the outer lands are relatively flat but the inner lands are rounded. As shown in FIG. 6*b*, the rounded crests of the inner lands lie approximately within a common inner plane. It is apparent that the lands can have any suitable shape.

As shown in FIGS. 9*a* and 9*b*, each of the inner grooves 152 has a cupped bottom portion 158, and each of the outer grooves 162 also has a cupped bottom portion 168. Although such cupped bottom portions 158, 168 are shown as rounded, it is apparent that other suitable shapes would produce the same results.

As shown in FIGS. 9*a* and 9*b*, each of the opposite end portions 124, 125 comprise a base leg 145 which extends approximately perpendicular with respect to the corresponding closure wall 106, 107. The opposite end portions 124, 125 may further comprise a flexible arm 146 which is connected to the base leg 145. The flexible arm 146 is preferably positioned approximately perpendicular to the base leg 145. As shown in FIG. 9*b*, the opposite strap ends 141, 142 of the continuously elastic strap section 140 are connected to corresponding flexible arms 146 of the opposite end portions 124, 125.

As shown in FIG. 9*a*, in the open condition of the closure, flexible arm 146 is bent or curved at an approximately 90° angle away from the corresponding closure wall 106, 107. As shown in the preferred embodiment of FIG. 9*b*, in the closed condition of the closure, the flexible arm 146 is approximately straight. It is apparent that the flexible arm 146 can be positioned at any suitable angle.

FIGS. 9*a* and 9*b* show the end views of the film hinge 123 as triangular sections meeting at a line identified by element referenced numeral 123, referred to as the film hinge. It is apparent that the film hinge 123 of this invention can be constructed according to any suitable manufacturing method apparent to those skilled in the art of film hinge closures. For example, rather than forming straight sections which intersect at the line identified by element reference numeral 123, the internal surfaces of the film hinge 123 can also be curved, particularly in a concave direction, leaving a desired thickness of material at the position identified by element reference numeral 123.

Figure 8A:
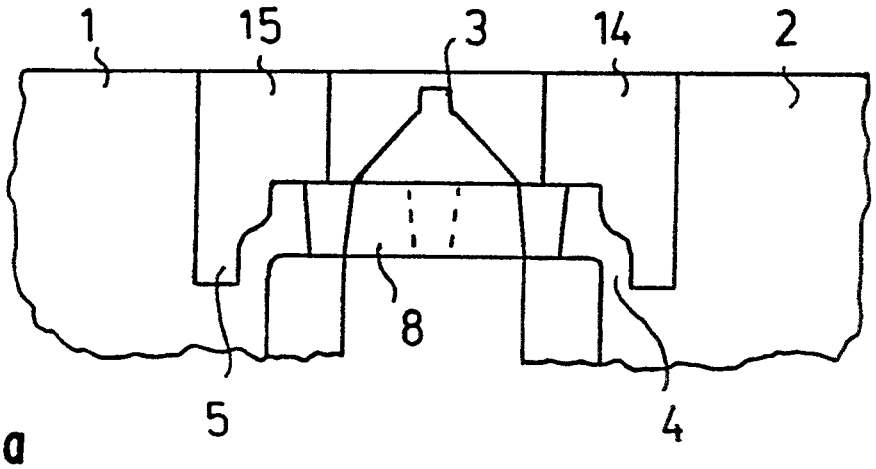
FIGS. 8*a* to 8*d* each show an enlarged view of the tension element in accordance with FIGS. 3*a* and 3*b;*
Figure 8B:
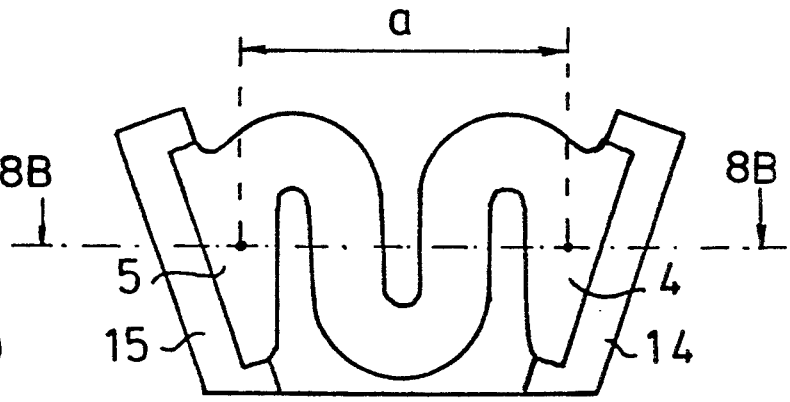
Figure 8C:
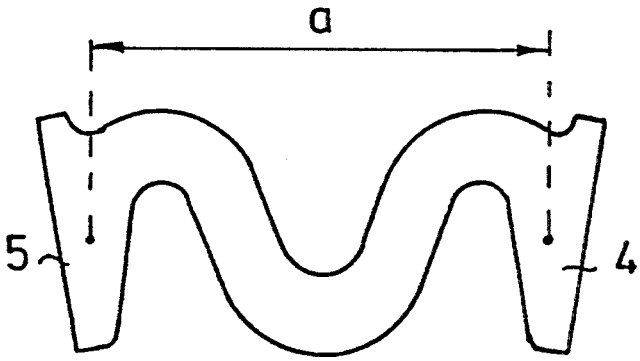
Figure 8D:
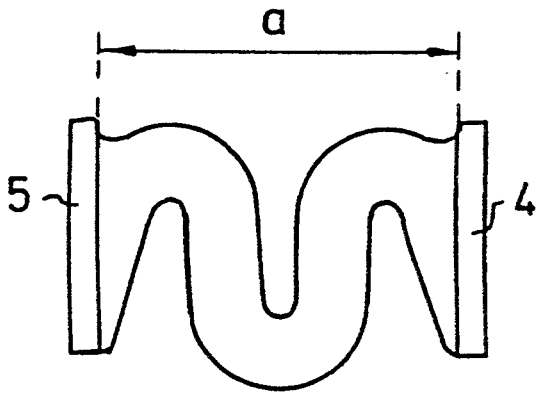

A tension element 8 in accordance with the embodiment of FIG. 3*a* is shown in detail in FIGS. 8*a* to 8*d*. FIG. 8*a* is a partial view of the closure in the area of the hinge. The illustration of FIG. 8*a* corresponds to the position during injection molding, where the closure is completely opened. Again the lower part 1 is connected with the upper part 2 via a film hinge 3. In this embodiment, the tension element 8 extends completely level and the attachment areas 4, 5 are disposed in recesses 14, 15 in the upper part 2 and the lower part 1. The same situation is shown in FIG. 8*b* in a top view of the tension strap. The drawing plane is that plane which is formed through the attachment areas 4, 5. If the distance between the centers of the two attachment areas 4, 5, located on the line B—8B as shown in FIG. 8*b*, is measured, it is apparent that in this position the distance is shortest. The embodiment of FIG. 8*b* is shown in a scale of about 10:1, and the preferred real or actual distance a is preferably 4.7 mm. However, in FIG. 8*c*, in which the closure is shown in its dead center position, the tension element 8 is changed to its greatest length, i.e. the individual partial elements are spread to the widest position. In this preferred embodiment, the actual distance a is preferably increased to 6.6 mm. This corresponds to an increase of approximately 40%. In the closed position of the closure as shown in FIG. 8*d*, the actual distance between the two attachment areas 4, 5 is still preferably 5 mm. Accordingly, the tension element 8 is still under stress even in the closed position of the closure. With respect to the relaxed position in accordance with FIG. 8*a* or FIG. 8*b*, the change in length still is more than 6%. The maximum elastic change in length of the tension elements 8 is advantageously selected to be between 10% and 50%. But this depends to a large extent on the geometric conditions. In addition to the percentage change of length, however, the pulling force exerted by the tension element 8 is important. This is affected on the one hand by the geometric design of the tension element 8 and, on the other hand, by the material strength of the partial sections. So that no deformation of the closure itself occurs, it is practical to make the wall thickness of the partial sections considerably less than the wall thickness of the shell walls in the area of the attachment points. If the percentage of the maximum elastic change in length $\Delta l$ is designed too small, then the snap effect only takes place in the range of dead center. As a lower limit, a 10% change in length in the area of dead center would be sensible.

As already shown by the few preferred embodiments in accordance with the drawings, the choice of the different variants in the design of the closures in accordance with the invention is almost unlimited. This is a very important advantage, especially for plastic snap hinge closures. Almost every manufacturer of cosmetic products, food or technical chemicals desires a special design adapted to the packaging of its products. The designer now actually has almost unlimited possibilities available with the help of the hinge according to this invention.

I claim:

1. In a plastic snap hinge closure having a film hinge (123) connecting a lower part (101) and an upper part (102), and at least one tension element (128) having two opposite end portions (124, 125) connected to a corresponding closure wall (106, 107) of each of said lower part (101) and said upper part (102), the improvement comprising:

each said tension element (128) having a cross section with an overall sinuous shape, a continuously elastic strap section (140) of each said tension element (128) having an inner side (150) and an outer side (160), said inner side (150) having a plurality of inner grooves (152) spaced with respect to each other, said outer side (160) having a plurality of outer grooves (162) spaced with respect to each other, an inner land (154) positioned between two adjacent said inner grooves (152), an outer land (164) positioned between two adjacent outer grooves (162), and along an axis of elasticity (170) of each said continuously elastic strap section (140) each said inner groove (152) positioned opposite a corresponding said outer land (164) and each said outer groove (162) positioned opposite a corresponding said inner land (154).

2. In a plastic snap hinge closure according to claim 1 wherein each said inner land (154) is flat and each said inner land (154) lies approximately within an inner plane (156).

3. In a plastic snap hinge closure according to claim 1 wherein each said outer land (164) is flat and each said outer land (164) lies approximately within an outer plane (166).

4. In a plastic snap hinge closure according to claim 3 wherein each said inner land (154) is flat, each said inner land (154) lies approximately within an inner plane (156), and said outer plane (166) is approximately parallel to said inner plane (156).

5. In a plastic snap hinge closure according to claim 1 wherein each said inner groove (152) has a cupped bottom portion (158).

6. In a plastic snap hinge closure according to claim 1 wherein each said outer groove (162) has a cupped bottom portion (168).

7. In a plastic snap hinge closure according to claim 1 wherein said opposite end portions (124, 125) are integrated into said corresponding closure wall (106, 107).

8. In a plastic snap hinge closure according to claim 1 wherein each of said opposite end portions (124, 125) has a base leg (145) extending approximately perpendicular from said corresponding closure wall (106, 107) and a flexible arm (146) connected to said base leg (145), said flexible arm (146) positioned approximately perpendicular to said base leg (145), and opposite strap ends (141, 142) of said continuously elastic strap section (140) connected to corresponding said flexible arms (146) of said opposite end portions (124, 125).

9. In a plastic snap hinge closure according to claim 8 wherein in a closed condition of the plastic snap hinge closure each said flexible arm (146) is approximately straight.

10. In a plastic snap hinge closure according to claim 8 wherein in an open condition of the plastic snap hinge closure each said flexible arm (146) is bent at an approximately 90° angle away from said corresponding closure wall (106, 107).

11. In a plastic snap hinge closure according to claim 1 wherein two said tension elements (128) are positioned on opposite sides of said film hinge (123).

12. In a plastic snap hinge closure according to claim 1 wherein said inner grooves (152) are parallel to each other.

13. In a plastic snap hinge closure according to claim 1 wherein said outer grooves (162) are parallel to each other.

* * * * *